US005977500A

United States Patent [19]

Mohtasham

[11] Patent Number: 5,977,500

[45] Date of Patent: Nov. 2, 1999

[54] SWITCH ASSEMBLIES

[75] Inventor: Mehdi Mohtasham, Hindley Green, United Kingdom

[73] Assignee: E. J. A. Engineering Limited, Wigan, United Kingdom

[21] Appl. No.: 08/945,128

[22] PCT Filed: Mar. 14, 1996

[86] PCT No.: PCT/GB96/00578

§ 371 Date: Jan. 8, 1998

§ 102(e) Date: Jan. 8, 1998

[87] PCT Pub. No.: WO96/33504

PCT Pub. Date: Oct. 24, 1996

[30] Foreign Application Priority Data

Apr. 19, 1995 [GB] United Kingdom ..... 9507933

[51] Int. Cl.[6] ..... H01H 27/00

[52] U.S. Cl. ..... 200/574; 200/17 R; 200/43.07; 200/61.62

[58] Field of Search ..... 200/17 R, 43.01, 200/43.04–43.09, 61.62–61.68, 574, 334

[56] References Cited

FOREIGN PATENT DOCUMENTS

| | | | |
|---|---|---|---|
| 40 31 348 | 4/1991 | Germany | F16P 3/10 |
| 40 39 652 | 3/1992 | Germany | H01H 3/20 |
| 90/08396 | 7/1990 | WIPO | H01H 27/00 |
| 93/24947 | 12/1993 | WIPO | H01H 27/00 |

*Primary Examiner*—Michael A. Friedhofer
*Attorney, Agent, or Firm*—Pillsbury Madison & Sutro, LLP

[57] ABSTRACT

A switch comprises a housing containing electrical contacts moveable from a power supply OFF position to a power supply ON position. A control mechanism is operatively coupled to the contacts, which contacts are operable by an actuator of predetermined configuration engaging with the control mechanism to change the status of the contacts. The control mechanism is moveable relative to the actuator in a direction transverse to the direction of insertion of the actuator to facilitate operative engagement therewith.

13 Claims, 2 Drawing Sheets

SWITCH ASSEMBLIES

BACKGROUND OF THE INVENTION

1. Field of the Invention

This invention relates to switch assemblies used especially but not exclusively in machinery guards enclosing kinetic machinery.

2. Description of Related Art

Known switch assemblies comprise a switch adapted to be fitted to an enclosure and an actuator adapted to be fitted to a door, gate or protective cover of the enclosure and insertable into the switch. When the enclosure is closed by the door, gate or protective cover, the actuator is inserted into the switch which enables the energisation of a machine within the enclosure as the result of the switch turning on an electrical power supply.

Switches of this type have a housing in which are situated normally-open contacts, one set fixed, the other movable and carried by an axially-movable push rod spring-loaded to maintain the sets of contacts apart and the power supply consequently OFF.

The axially-movable push rod bears against a rotatable, can of a cam arrangement normally disposed to secure the push rod in a power supply OFF position but which is operable by the actuator to cause cam rotation and axial movement of the push rod to a power supply ON position.

BRIEF SUMMARY OF THE INVENTION

These known switches suffer from the disadvantage that should the enclosure and door become misaligned slightly the actuator is not able to enter the switch housing to operate the contacts when the door is closed.

It is an object of the present invention to provide a switch assembly in which such disadvantage is obviated or mitigated.

According to the present invention there is provided a switch comprising a housing containing electrical contacts movable from a power supply OFF position to a power supply ON position and a control mechanism operatively coupled to the contacts, the contacts being operable by an actuator of predetermined configuration engaging with the control mechanism to change the status of the contacts, characterised in that the control mechanism is moveable relative to the actuator in a direction transverse to the direction of insertion of the actuator to facilitate operative engagement therewith.

Hence if the actuator and control mechanism are misaligned, the control mechanism is moveable into alignment.

The control mechanism may be moveable along a predetermined axis and is conveniently biased to a predetermined position.

Preferably the control mechanism is biased to said predetermined position by means of compression springs located at each side thereof.

The control mechanism may be slidably mounted on a shaft.

Preferably the control mechanism has at least one entry port which is shaped to guide the actuator into operative engagement with the mechanism. The entry port may have a ramped guide surface around its periphery.

Preferably the guide surface is a raised profile defined on a casing in which the entry port is formed, which casing houses the control mechanism and is moveable with the control mechanism.

The control mechanism may comprise an actuating cam adapted to be rotated about a predetermined axis by the actuator in order to operate the contacts.

The actuating cam is preferably rotatably mounted on said shaft.

The control mechanism may have a locking member engageable with the actuating cam to prevent rotation thereof except when the actuator is inserted. dr

BRIEF DESCRIPTION OF THE DRAWINGS

A specific embodiment of the present invention will now be described, by way of example only, with reference to the accompanying drawings, in which.

DETAILED DESCRIPTION OF THE INVENTION

Figure 1:
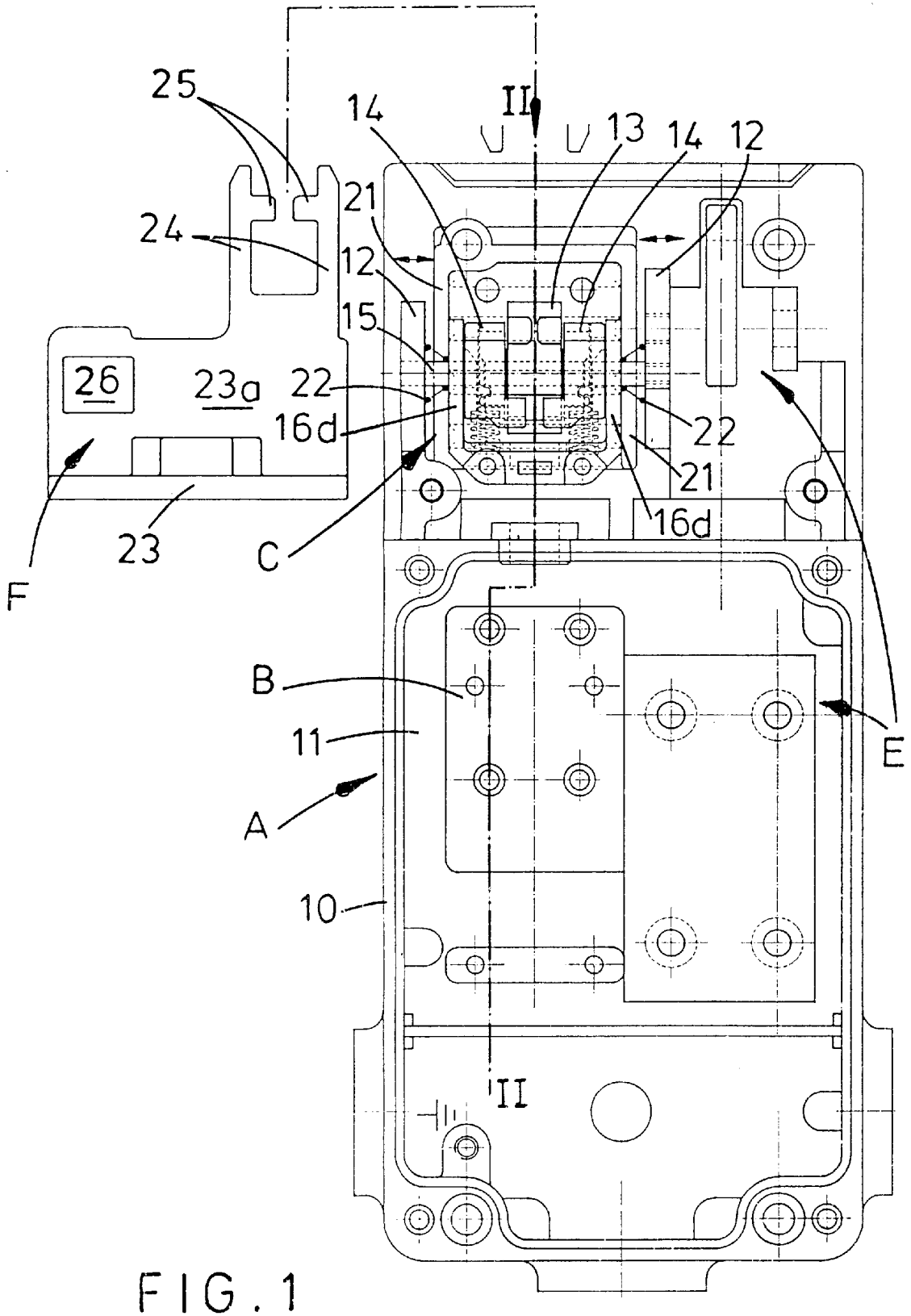
FIG. 1 is a front view of the switch with face plate removed to show a contact block and control mechanism with enclosure partially removed.

Referring now to the drawings, the switch assembly comprises a switch A which contains an electrical contact arrangement B, an operating cam arrangement C, a connecting rod arrangement D, a solenoid operated lock E, and an actuator F which operationally cooperates With the switch A.

The relationship between these components and their operation is well known, an example being described in our European patent application no. 93913242.9 (publication no. 0620948), and they are not described in detail here except with reference to aspects of the present invention, A housing 10 has an electrical contact compartment 11 at one end and, at its other end, has two parallel laterally-spaced walls 12 for mounting the cam arrangement C.

The contact compartment 11 is open to the front of the casing 10 and is closed by a faceplate (not shown) with an intervening gasket (not shown), both removable to permit access to the contact arrangement B.

Figure 2:
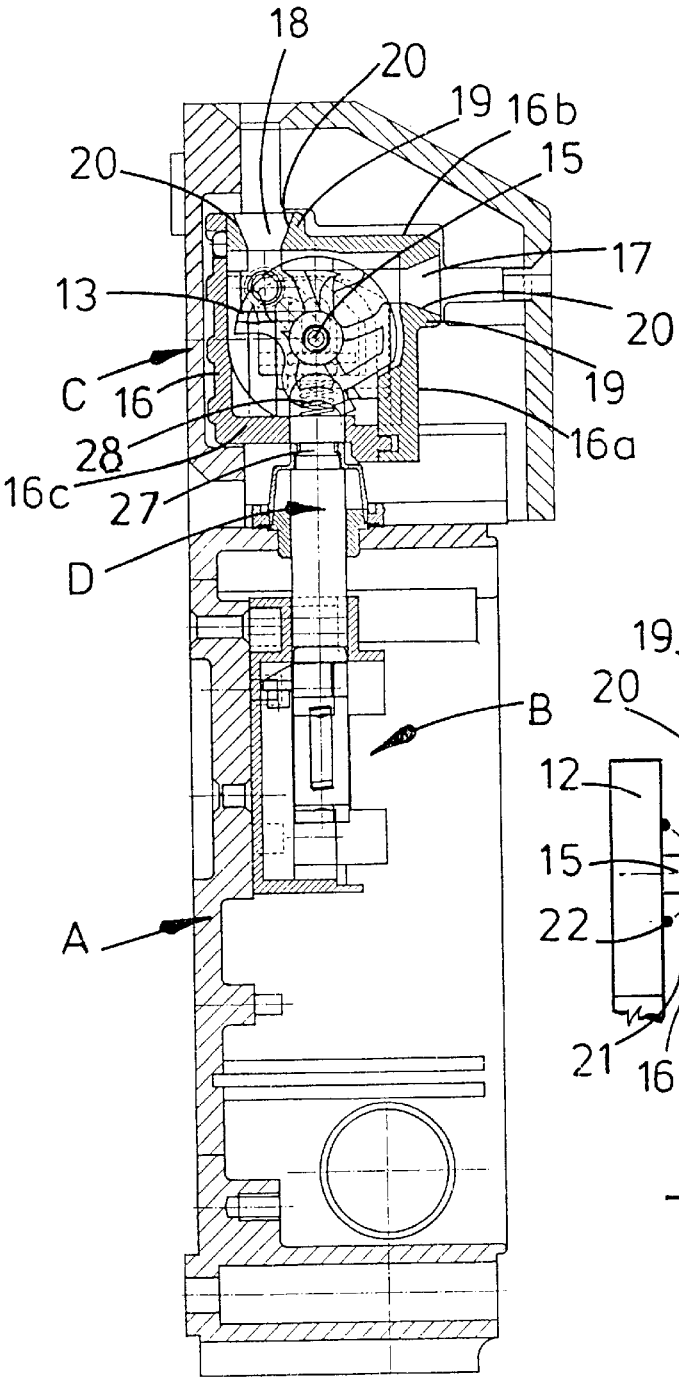
FIG. 2 is a partial sectional side view on the line II—II of FIG. 1.
Figure 3:
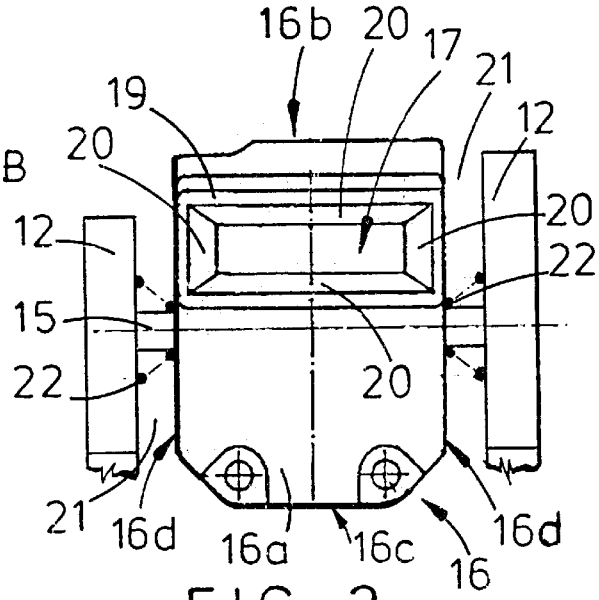
FIG. 3 is a view of an end face of an enclosure for the control device.

The cam arrangement C comprises a rotatable cam 13 and locking members 14 mounted on a shaft 15 supported at its ends in apertures in the laterally spaced walls 12 as is well known. The arrangement C is housed in a box-like enclosure 16 (see FIGS. 2 and 3) with front 16*a*, top 16*b*, bottom 16*b*, rear (hidden in FIG. 3) and side walls 16*b*. The enclosure 16 is formed at one corner of its front wall 16*a* with a rectangular opening defining an actuator entry port 17 and at one corner of its top wall 16*b* with a similar port 18 (see FIG. 2). Each entry port 17,18 is bordered by a raised peripheral wall 19 having ramped surfaces 20 inclined inwardly and rearwardly towards the opening. The shaft 15 projects from the side walls 16*b* of the enclosure 16 and is received in corresponding apertures in the laterally spaced walls 12 on the housing 10. There is a clearance 21 between the enclosure 16 and the laterally spaced walls 12 which enables the enclosure 16 and its contents to slide along the shaft 15 relative to the housing 10. A compression spring 22 is mounted on the shaft 15 in each clearance 21 to bias the enclosure 16 to a central position between the lateral walls 12.

The enclosure 16 is separable into two parts. A front portion comprising the front 16*a* and top walls 16*b* is screw connected to a rear portion comprising rear, side 16*d* and bottom 16*c* walls. The two portions are shown assembled in FIG. 2 but the front portion has been removed in the representation shown in FIG. 1.

The making and breaking of contacts is effected by the connecting rod arrangement D which is connected between the cam arrangement C and the contact arrangement B as is well known.

The actuator entry ports 17,18 are aligned with the actuator cam 13 and locking members 14.

The other component of the switch, namely the actuator F is formed, for example of stainless steel. It comprises a mounting bar 23, from which projects a plate 23*a* with two parallel actuating limbs 24 partially bridged by ears parallel 25 to the mounting bar 23. The plate 23*a* has a rectangular aperture 26 at one side.

The above described switch A is to be used, inter alia, in connection with machinery guards (not shown), the switch A being mounted on the guard housing and the actuator F on the guard gate or door which may be hinged, slidable or of lift-off construction.

The electrical circuitry, well known to those skilled in the art of providing electrical interlocks between kinetic machinery and machine guards therefor, will not be described other than to indicate that machinery operation is inhibited until the contacts are closed.

Inadvertent or unauthorized rotation of the cam arrangement C is prevented or resisted by the inter-engagement of the actuator cam 13 and locking members 14.

When the guard door or gate is closed, the actuator F. enters the entry port 17 or entry port 18 depending upon the disposition of the switch A. The limbs 24 of the actuator F engage with the locking members 14 and the actuating cam 13 to rotate the latter. Rotation of the cam 13 causes an axial push rod 27 of the connecting rod arrangement D to move axially against the action of a spring 28 to close the contacts to permit the machinery to start which condition will prevail as long as the actuator F is so engaged in the switch A.

Insertion of the actuator F into the switch causes deflection of a hook-like member (not shown) on the solenoid such that a plunger of the solenoid retracts slightly. When the hook-like member is aligned with the aperture 26 in the actuator F it engages therewith and the plunger reverts to its full extension.

Retraction of the actuator F out of the switch A is prevented by engagement of the hook-like member (not shown) of the solenoid operated lock E in the aperture 26 of the actuator F. Retraction of the actuator F out of switch A is only possible by actuation of the solenoid so that its plunger retracts thereby to release the actuator F. The solenoid may be energized to cause retraction by a remote switch or the like. Such a solenoid locking mechanism is well known and is not described in detail here.

If the actuator F is slightly misaligned relative to the switch A and the corresponding entry port 17 or 18, the ends of the actuator limbs 24 first engage the ramp surfaces 20 at the sides of the raised peripheral wall 19. The force exerted by the actuator F on the wall 19 causes the enclosure 16 and its contents to move laterally, against the biasing force of one of the springs 22, along the shaft 15 until the limbs 24 are correctly aligned with the entry port 17,18. The actuator F is then able to enter the port 17,18 to operate the switch. The cam arrangement C thus effectively "floats" relative to the switch housing A.

The housing may have an end cap 10*a* covering the enclosure and laterally spaced walls 12 to prevent ingress of dirt or dust etc. The end cap 10*a* has enlarged openings aligned with the entry ports 17,18 to permit entry of the actuator F.

The arrangement of the present invention can be used in and to operate electrical switches other than that described with reference to the drawings and consequently the present invention also includes within its scope the actuator cam and locking member arrangement per se.

It will be understood that numerous modifications could be made to the above described design without departing form the scope of the invention as defined in the appended claims, for example any form of control mechanism which operates the contacts could be used.

I claim:

1. A switch comprising a housing containing electrical contacts moveable from a power supply OFF position to a power supply ON position and a control mechanism operatively coupled to the contacts, the control mechanism being operable by insertion into the housing of an actuator of pre-determined configuration in a pre-determined direction to engage the control mechanism and thereby to change a status of the contacts, characterized in that the control mechanism is supported in a housing sub-assembly movably mounted on a body of the housing. insertion of the actuator into the housing causing displacement of the control mechanism within the housing sub-assembly to change the status of the contacts, and the housing sub-assembly being displaceable with the control mechanism relative to the housing body in a direction transverse to the direction of insertion of the actuator to facilitate operative engagement between the actuator and the control mechanism.

2. A switch according to claim 1, wherein the control mechanism is moveable along a predetermined axis.

3. A switch according to claim 1 or 2, wherein the control mechanism is biased to a predetermined position.

4. A switch according to claim 3, wherein the control mechanism has a first side and a second side and is biased to said predetermined position by means of compression springs located at each side.

5. A switch according to claim 1, wherein the control mechanism is slidably mounted on a shaft.

6. A switch according to claim 1, wherein the control mechanism has at least one entry port which is shaped to guide the actuator into operative engagement with the control mechanism.

7. A switch according to claim 6, wherein the entry port has a ramped guide surface around its periphery.

8. A switch according to claim 7, wherein the guide surface is a raised profile defined on a casing in which the entry port is formed, which casing houses the control mechanism and is moveable with the control mechanism.

9. A switch according to claim 1, wherein the control mechanism comprises an actuating cam adapted to be rotated about a predetermined axis by the actuator in order to operate the contacts.

10. A switch according to claim 9, wherein the actuating cam is rotatably mounted on said shaft.

11. A switch according to claim 9 or 10, wherein the control mechanism has a locking member engageable with the actuating cam to prevent rotation thereof except when the actuator is inserted.

12. A switch according to claim 1, wherein the control mechanism is laterally moveable relative to and between spaced walls of the housing.

13. A switch comprising:

means for housing electrical contacts, the contacts being movable from a power supply OFF position to a power supply ON position; and means for controlling the electrical contacts, the contacts being operable by an actuator of predetermined configuration engaging with the controlling means to change a status of the contacts, means for supporting the controlling means and which is movably mounted on the housing means, the controlling means and the supporting means being moveable relative to the actuator in a direction transverse to the direction of insertion of the actuator to facilitate operative engagement therewith.

* * * * *